US006624792B1

(12) United States Patent
Chu et al.

(10) Patent No.: US 6,624,792 B1
(45) Date of Patent: Sep. 23, 2003

(54) QUAD-RIDGED FEED HORN WITH TWO COPLANAR PROBES

(75) Inventors: Tai-Tseng Chu, Simi Valley, CA (US); Amedeo Larussi, Oxnard, CA (US)

(73) Assignee: Titan Systems, Corporation, San Diego, CA (US)

( * ) Notice: Subject to any disclaimer, the term of this patent is extended or adjusted under 35 U.S.C. 154(b) by 0 days.

(21) Appl. No.: 10/150,175

(22) Filed: May 16, 2002

(51) Int. Cl.[7] ..... H01Q 13/00; H01P 1/16

(52) U.S. Cl. ..... 343/786; 343/772; 333/21 A; 333/136; 333/137

(58) Field of Search ..... 343/771, 772, 343/786; 333/21 A, 122, 136, 137

(56) References Cited

U.S. PATENT DOCUMENTS

| | | | | |
|---|---|---|---|---|
| 3,886,561 A | | 5/1975 | Beyer | |
| 3,972,043 A | | 7/1976 | Locus | |
| 4,001,835 A | | 1/1977 | Dover et al. | |
| 4,210,915 A | | 7/1980 | Kienberger et al. | |
| 4,608,572 A | | 8/1986 | Blakney et al. | |
| 4,642,651 A | | 2/1987 | Kuhn | |
| 4,755,820 A | | 7/1988 | Backhouse et al. | |
| 4,973,965 A | | 11/1990 | Ridge et al. | |
| 5,017,937 A | | 5/1991 | Newham et al. | |
| 5,084,711 A | | 1/1992 | Moss et al. | |
| 5,185,613 A | | 2/1993 | Whatmore et al. | |
| 5,398,037 A | | 3/1995 | Engheta et al. | |
| 5,455,589 A | | 10/1995 | Huguenin et al. | |
| 5,459,441 A | * | 10/1995 | Weber et al. | 333/136 |
| 5,517,203 A | * | 5/1996 | Fiedziuszko | 343/756 |
| 5,528,254 A | | 6/1996 | Howng et al. | |
| 5,625,368 A | | 4/1997 | Howson et al. | |
| 5,737,698 A | | 4/1998 | Gabrelian et al. | |
| 6,011,521 A | | 1/2000 | Knop et al. | |
| 6,271,799 B1 | * | 8/2001 | Rief et al. | 343/776 |
| 6,445,356 B1 | * | 9/2002 | Yuanzhu | 343/786 |
| 6,452,561 B1 | * | 9/2002 | West et al. | 343/772 |
| 6,529,089 B2 | * | 3/2003 | Yuanzhu | 333/21 A |

* cited by examiner

*Primary Examiner*—Tan Ho
(74) *Attorney, Agent, or Firm*—Edward A. Sokolski

(57) ABSTRACT

The invention utilizes two nominally orthogonal probes to couple selectively to two orthogonal modes propagating in a microwave waveguide and horn. The waveguide and horn utilize internal ridges to obtain broad bandwidth and the two probes are located in substantially the same plane in order to avoid introducing large changes in the relative phases of the two modes propagating within the waveguide with changes in frequency over the operating bandwidth of the device. The middle portion of each probe is bent or deformed to the extent needed to avoid physical conflict and electrical contact between the probes, while still avoiding the introduction of substantial phases differences between the modes excited by the respective probes.

8 Claims, 3 Drawing Sheets

QUAD-RIDGED FEED HORN WITH TWO COPLANAR PROBES

CROSS-REFERENCES TO RELATED APPLICATION

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Field of the Invention

The invention pertains to microwave radio receiving and transmitting antennas. More particularly this invention pertains to dual-polarized, wide-band feed horns.

2. Description of the Prior Art

Microwave horns attached to the end of microwave waveguides have long been used as radio antennas for receiving an sending electromagnetic energy. Microwave horns also have been used as part of more complex antenna systems to feed, i.e. to send and receive, electromagnetic energy to and from reflectors or to and from dielectric or metallic electromagnetic lenses. In most applications the operational bandwidth of such waveguides and horns is limited to the range of frequencies of the electromagnetic waves that can propagate in a single, fundamental mode within the waveguide, without also being able to propagate in higher, different modes. In the prior art the operational bandwidth of these waveguides and horns has been broadened by including internal ridges within the waveguides and horns, which ridges increase the separation between the lowest frequency at which the fundamental electromagnetic mode will propagate within the waveguide and the lowest frequency at which a higher mode also will propagate. Typically, a probe or conducting post located within the waveguide electromagnetically couples a coaxial transmission line to the electromagnetic wave propagating within the waveguide.

The prior art also includes waveguides and horns having a circular or square cross-section that support the dual propagation of two orthogonal, fundamental electromagnetic modes that can be used to send and receive two, differently polarized waves of electromagnetic energy. Two, short conducting posts, or probes, located within the square or circular waveguide electro-magnetically connect two coaxial transmission lines to the two electromagnetic modes propagating within the waveguides. In such dual mode waveguides, the two probes typically are mounted at right angles to each other so that each probe will only excite, i.e. be electromagnetically connected with, one of the two fundamental modes propagating within the waveguide. In the prior art, because of physical and electrical problems, the two probes were located at different positions along the length of the waveguide, which difference in positions caused differences in the phase relationship between the two propagating modes that are excited by the respective probes, which differences in phase change as a function of frequency and, as a consequence, degrade the operation over wide bandwidths of such dual mode devices.

A report authored by J. K. Shimizu published in the IRE Transaction on Antennas and Propagation, vol. AP-9, pp. 223–224, March, 1961 describes an octave-bandwidth feed horn for a paraboloid that utilizes a horn having four internal tapered ridges. An article titled Broadband Ridged Horn Design, by K. L. Walton & V. C. Sundberg, published in Microwave Journal, vol. 7, pp. 96–101, March 1964 also describes the design of such horns and the Antenna Engineering Handbook, by R. C. Johnson, published by McGraw-Hill, at p. 40–4 presents curves showing the relationship between the wavelength of a mode propagating within a rectangular waveguide having four interior ridges and the dimensions of the ridges.

BRIEF SUMMARY OF THE INVENTION

The present invention substantially reduces the phase differences between the two modes propagating within a dual mode, ridged waveguide and horn by locating the two probes within the waveguide at substantially the same position along the lengthwise dimension of the waveguide. The invention avoids electrical and mechanical conflict between the two probes by displacing or bending the center portions of the two probes in opposite directions.

DETAILED DESCRIPTION OF THE INVENTION

Figure 1:
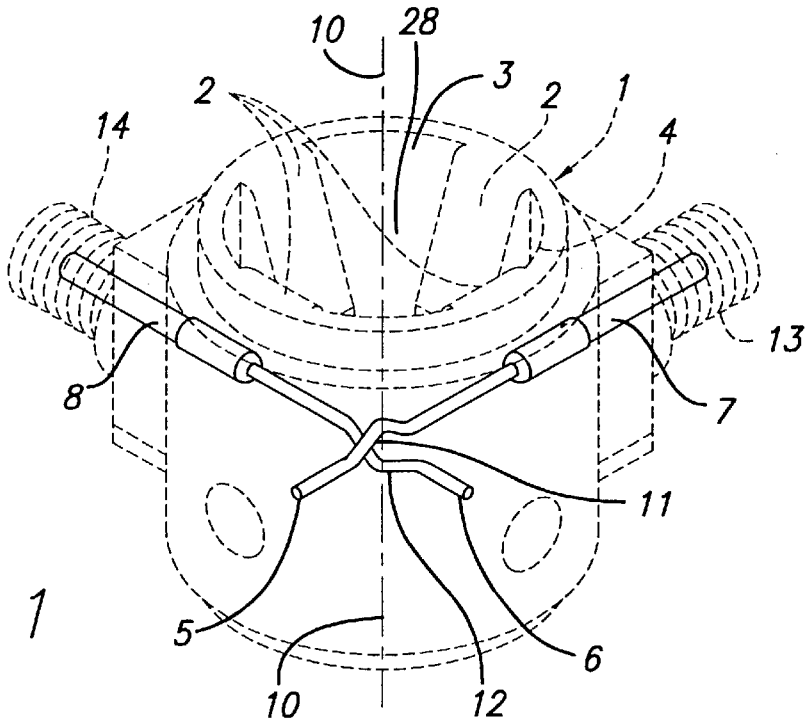
FIG. 1 is a pictorial view of the invention.
Figure 2:
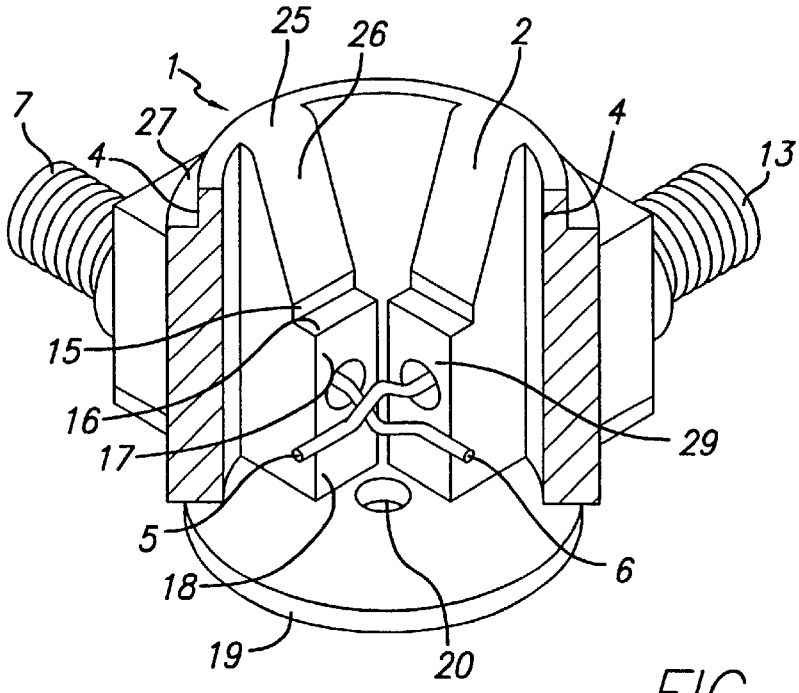
FIG. 2 is pictorial view of a section of the invention.
Figure 3:
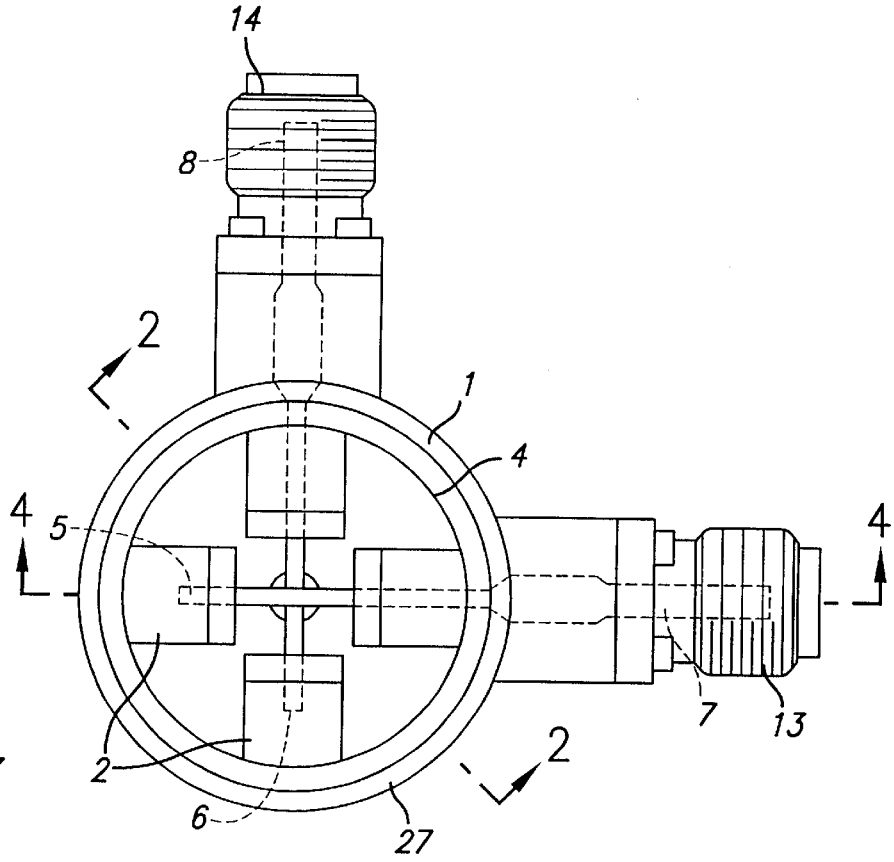
FIG. 3 is a view looking at the horn-end of the invention.

FIGS. 1 through 5 depict the preferred embodiment of the invention. These figures depict circular waveguide and horn 1 that includes a circular waveguide section 29 and a circular horn section 28. At one end, the horn section 28 connects to waveguide section 29 and the other, open end 3 of horn section 28 opens to free space. Both the waveguide section 29 and horn section 28 have an inner circumference 4 which is of constant size throughout the length of these two sections. At the center frequency of operation, the inner circumference 4 has a diameter of 0.745 free-space wavelengths. Circular waveguide and horn 1 includes four ridges 2 within its inner circumference 4. In the waveguide section the ridges have a constant cross-section. In the horn section, the ridges are tapered such that at the open end 3 of horn section 28 the ridges become very small or vanish. Each ridge includes a step up in height at the transition from the horn section to the waveguide section.

Probes 5 and 6 are located within the waveguide section 29 and are electrically connected respectively to the ends of the center conductors within coaxial transmission lines 7 and 8. The opposite ends of the coaxial transmission lines 7 and 8 terminate at their respective coaxial connectors 13 and 14.

In the preferred embodiment, ridged, circular waveguide section 29 and ridged, circular horn section 28 each supports two, orthogonal TE11 modes of propagation. The field distribution in the second TE11 mode is rotated ninety degrees about centerline 10 relative to the field distribution in the first TE11 mode. Coaxial transmission lines 7 and 8 are oriented normal to centerline 10 and normal to each other. Probe 5 is coupled to the first TE11 mode and probe 6 is coupled to the second TE11 mode. With the exception of bended portions 11 and 12 of probes 5 and 6, these probes are oriented normal to centerline 10 and to each other. Because each probe is basically oriented at right angles to the other, each probe couples primarily only to its respective TE11 mode.

Figure 6:
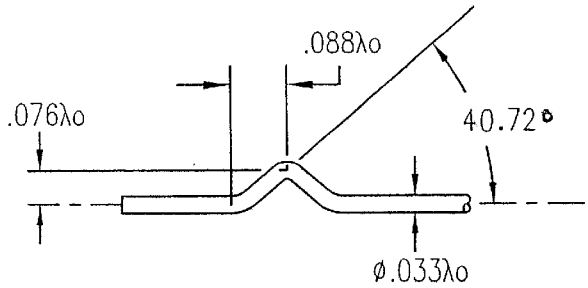
FIG. 6 depicts a portion of one of the probes.

In order to avoid direct electrical and physical contact between probes 5 and 6, these probes include their respective bended portions 11 and 12. FIG. 6 depicts in detail the bended portion of one of these probes. Because the bended portion of each probe is oriented to lie within a plane containing centerline 10 and the remainder of the probe, the cross-coupling between the probe and the other, orthogonal TE11 mode is relatively small.

With the exception of the offset between bended portions 11 and 12, probes 5 and 6 are positioned in the same plane, referred to here as the probe plane, which probe plane is normal to centerline 10 of circular waveguide. From an electrical standpoint, the probes thus are located in approximately the same position relative to the lengthwise dimension of the waveguide and horn sections and in the same electrical position relative to the propagation of the TE11 modes within the waveguide section. As a consequence, the phase relationship between the first TE11 mode excited within the circular waveguide section by its respective probe and the probe voltage is nearly the same as the phase relationship between the second TE11 mode and its respective probe voltage.

The four ridges 2 have identical dimensions. Each ridge has six sections, a tip 25, a tapered ridge 26, a flat ridge 15, a ridge step 16, a center flat ridge 17 and a back ridge 18. In the preferred embodiment, tapered ridge 26 may comprise a single sloped surface, or a gently curved surface or a sequence of one or more flat surfaces having slightly different slopes that together approximately a gently curved surface. Together, these portions of each ridge form a higher order transformer. The first five sections 25, 26, 15, 16 and 17, transform the free space impedance into the waveguide impedance presented at the plane of the probes. Because of the relatively short length from the plane of the probes to the horn end of the waveguide, the effect of ridge step 16 is combined with the tapered shape of the ridges to transform the free space impedance to the impedance presented at the plane of the probes. The back ridge 18 is directly attached to back plate 19. The back ridge 18 portion of the ridged waveguide is approximately one-quarter wavelength in length and acting in combination with the shorting effect of back plate 19 presents a high impedance at the plane of the probes. For initial design purposes, the tapered ridges can be treated as having a series of steps and as being as a sequence of transformers. Following the initial design, high frequency, finite element, modeling software, e.g. HFSS software, can be used to model and adjust the actual smoothly tapered shape of the ridges to obtain the desired performance. "HFSS" software, i.e. "High Frequency Structure Simulator" software is commercially available software from Ansoft Corporation, that uses finite element approximations-for calculation the electrical properties of antenna, horns, and other electromagnetic devices. Various other software vendors market other software packages that can be similarly used to calculate such properties.

Figure 4:
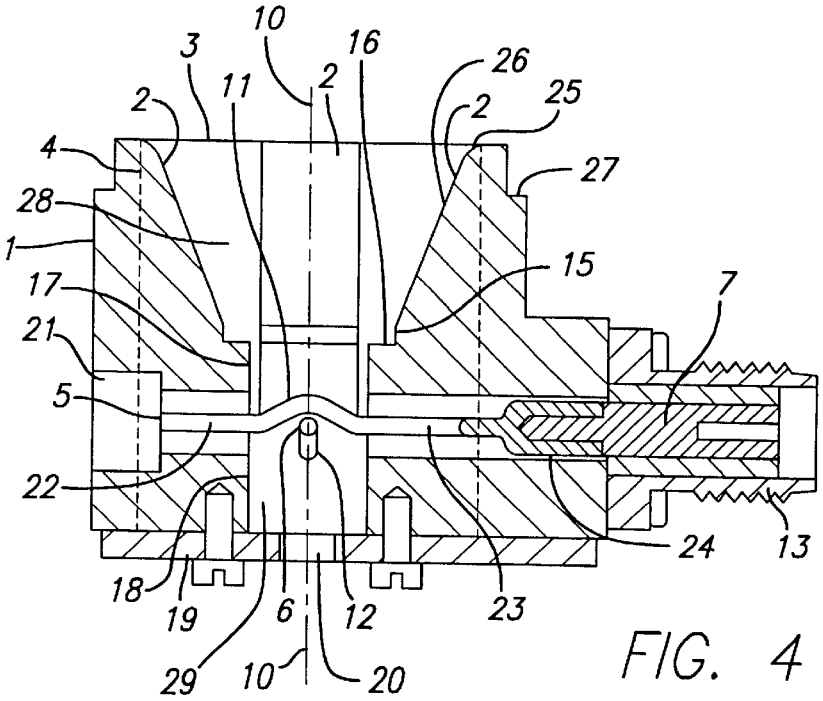
FIG. 4 is a cross-sectional view of the invention in which the view plane coincides with the length-wise dimension of the waveguide and the length-wise dimension of the coaxial waveguide connected to one of the probes.

As depicted in FIG. 4, each probe assembly consists of five sections, namely a circular opening 21, a compensation stub 22, the bended cross-over portion 11 or 12 of the respective probe, a first quarter-wavelength coaxial transformer 23 and a second quarter-wavelength coaxial transformer 24. The circular opening 21 determines the coupling of the end of stub 22 to the conducting wall. Stub 22 compensates for, i.e. cancels out, the inductance in the probe introduced by the bended portion of the probe. The angle of bend in the bended portion 11 or 12 of the probe is adjusted so as to improve isolation between the modes generated by the respective probes. To facilitate assembly, the height of the bend is limited by the inside diameter of the conductor that forms the outside boundary of coaxial transformer 23. The appropriate angle of bend can be determined by using high frequency, finite element modeling software, e.g. HFSS software, to calculate the angle of bend that produces the greatest isolation between the modes while at the same time minimizes any differences in phasing between the two probes and the propagating modes to which they are coupled. The best combination of high isolation and low phase distortion between the two probes and their propagating modes can be improved by making the length from the bended portion to the end of the probe for one probe slightly shorter than for the other probe. One could, instead, or in addition, shift the distance from the bended portion of one probe to its respective coaxial transformer by a small amount relative to that of the other probe to achieve a similar improvement. The first and section quarter-wavelength transformers, transform the probe impedance so as to match the 50 ohm impedance of the respective coaxial transmission line 7 or 8.

Back plate 19 includes a circular hole 20, which hole further improves isolation by adding some symmetry with respect to the bended probes in that hole 20 balances, at least in part, the effect of the large hole, i.e., the opening to free space at the other end 3 of the horn section that is located on the opposite side of the probes. Again, high frequency, finite element, modeling software, e.g. HFSS Software, can be used to determine the appropriate hole dimensions. As the diameter of hole 20 is changed from small to large, the isolation between the two modes exhibits a maximum, which maximum determines the optimum size for hole 20. In the embodiment depicted in the figures, hole 20 has a diameter of 0.107 free-space wavelengths.

Open end 3 of horn section 28 includes a step 27 around the periphery of the horn opening. Step 27 alters the amount of current that flows at the horn aperture edges and helps control the beamwidth of the radiation pattern from the horn. In the embodiment depicted in FIGS. 1 thru 5, the step has a width of 0.081 free-space wavelength.

Figure 5:
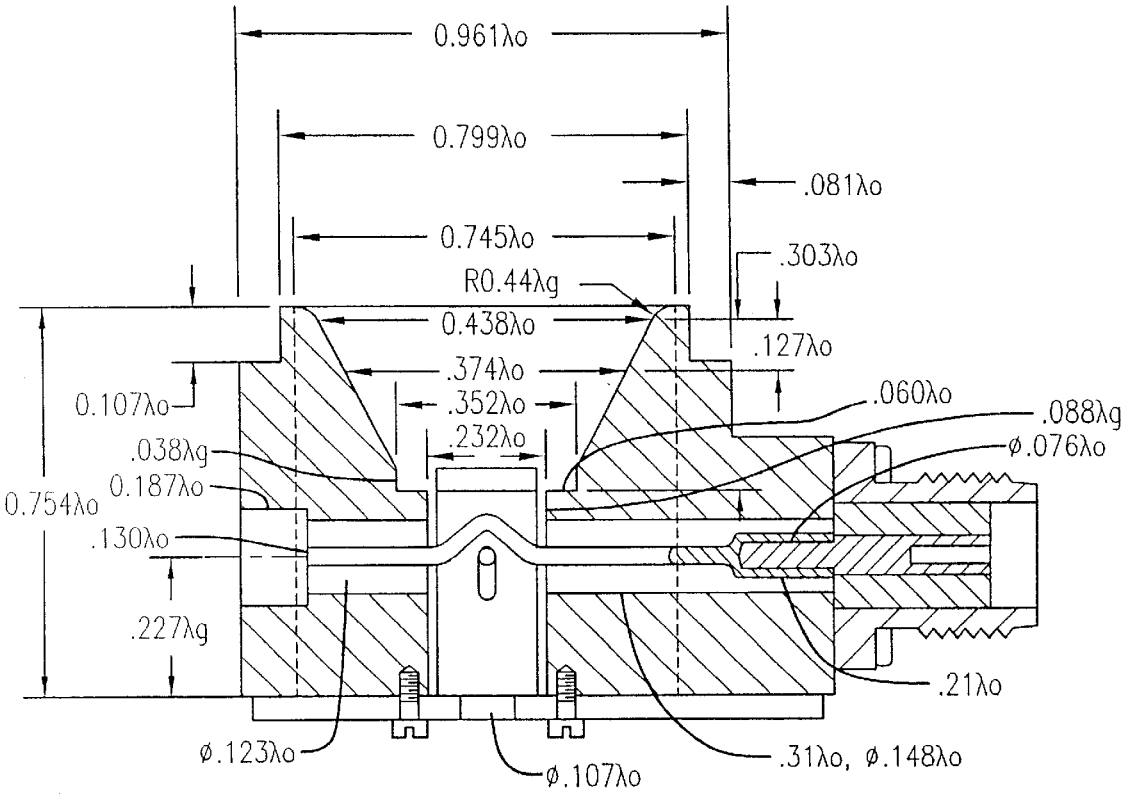
FIG. 5 is a sectional view of the invention that includes example dimensions.

FIGS. 5 and 6 include example dimensions for one embodiment of the invention. The dimensions are given either in terms of the free space wavelength, $\lambda_o$, at the design frequency, or in terms of the guide wavelength, $\lambda_g$, i.e. the wavelength within the waveguide section of the invention at the same design frequency, where the waveguide for which the wavelength is determined includes the four ridges. It should be understood, however, that other embodiments of the invention may have dimensions and details within the embodiment that differ from those disclosed in the examples.

What is claimed is:

1. A-microwave waveguide and horn comprising:

a waveguide section having a front and a rear end, the waveguide section being capable of supporting the propagation of electromagnetic waves in first and second modes and the waveguide section including a shorting plate at the rear end of the section;

a horn section having one end attached to the front end of the waveguide section and the other end opening to free space, the horn section also being capable of supporting the propagation of electromagnetic waves in first and second modes;

a first probe located in the waveguide section and being coupled predominantly to the first mode of propagation within the waveguide section and the first probe lying substantially in a first probe plane;

a second probe located within the waveguide section and being coupled predominantly to the second mode of propagation within the waveguide and the second probe lying substantially in a second probe plane;

the first and second probes being oriented at substantially right angles to each other and the first probe plane coinciding substantially with the second probe plane;

a portion of at least one of the probes departing sufficiently from its probe plane so as to avoid physical and electrical contact between the first and second probes.

2. The microwave waveguide and horn of claim 1, the waveguide section and the horn section having a common centerline along which the first and second modes of propagation propagate and the first and second probe planes being substantially normal to the common centerline.

3. The microwave waveguide and horn of claim 2 in which the waveguide section and the horn section include at least four internal ridges.

4. The microwave waveguide and horn of claim 3, in which each of the internal ridges is tapered within the horn section and in which internal ridge has a step at the junction between the waveguide section and the horn section.

5. The microwave waveguide and horn of claim 4 and further comprising:

a first coaxial transformer connected to the first probe, a second coaxial transformer connected to the first coaxial transformer, a third coaxial transformer connected to the second probe, and a fourth coaxial transformer connected to the third coaxial transformer.

6. The microwave waveguide and horn of claim 5 in which a portion of the first probe is bended to depart from the first probe plane and a portion of the second probe is bended to depart from the second probe plane, said departures being sufficient to avoid electrical and physical contact between the first and second probes.

7. The microwave waveguide and horn of claim 6 in which the shorting plate at the rear end of the waveguide section has a hole substantially aligned with the centerline of the waveguide.

8. The microwave waveguide and horn of claim 7 in which the length of the first probe is different than the length of the second probe.

* * * * *